US009224315B2

(12) United States Patent
Donat

(10) Patent No.: US 9,224,315 B2
(45) Date of Patent: Dec. 29, 2015

(54) DISPLAY BOARD

(76) Inventor: Donna Donat, Media, PA (US)

( * ) Notice: Subject to any disclaimer, the term of this patent is extended or adjusted under 35 U.S.C. 154(b) by 1210 days.

(21) Appl. No.: 11/561,372

(22) Filed: Nov. 17, 2006

(65) Prior Publication Data

US 2007/0124978 A1 Jun. 7, 2007

(51) Int. Cl.

| | |
|---|---|
| ***G09F 3/20*** | (2006.01) |
| ***G09F 1/12*** | (2006.01) |
| ***G09F 15/00*** | (2006.01) |

(52) U.S. Cl.

CPC .. *G09F 3/20* (2013.01); *G09F 1/12* (2013.01); *G09F 15/0012* (2013.01)

(58) Field of Classification Search

USPC ..... 40/657, 746, 791, 737, 798, 799, 624; D6/300, 563; 428/13; 248/489, 918; 359/833, 879; D19/54, 55, 52, 2, 26; D20/39; 52/785.1

See application file for complete search history.

(56) References Cited

U.S. PATENT DOCUMENTS

| | | | | | |
|---|---|---|---|---|---|
| 3,956,838 | A * | 5/1976 | Gerrish | 40/799 |
| 5,151,827 | A * | 9/1992 | Ven et al. | 359/848 |
| 5,174,054 | A * | 12/1992 | Politi | 40/737 |
| 5,483,386 | A * | 1/1996 | Carson | 359/883 |
| 6,119,999 | A * | 9/2000 | Fleishman | 248/489 |
| D489,906 | S * | 5/2004 | Hardy et al. | D6/300 |
| 7,007,421 | B2 * | 3/2006 | Kirschhoffer et al. | 40/658 |
| 2004/0216345 | A1 * | 11/2004 | Wadusky | 40/768 |

OTHER PUBLICATIONS

"French memo board", Mar. 25, 2004.*

"Make a Memory Board," Better Homes and Gardens, www.bhg.com/househome.

* cited by examiner

*Primary Examiner* — Syed A Islam

(74) *Attorney, Agent, or Firm* — Fox Rothschild LLP

(57) ABSTRACT

A display board is provided for displaying mementos. The board comprises a support board, a display panel, a filler material, a holder assembly, and at least one memento holder. The holder assembly has an outer edge and an inner edge that defines a window in the holder assembly for displaying the display panel. The holder assembly comprises a holder assembly member having a member panel, cushion pad and fabric layer. The memento holders are typically ribbons situated along the holder assembly, preferably in an intersecting manner. The methods of displaying the mementos using the display of the present invention are also provided.

21 Claims, 3 Drawing Sheets

DISPLAY BOARD

FIELD OF THE INVENTION

This invention relates to products and methods for displaying mementos. More particularly, the invention relates to a display board or frame including memento holders.

BACKGROUND OF THE INVENTION

Mementos such as photographs, post cards and theater tickets are conventionally stored in photo albums or boxes. These methods of storage, however, are not suitable for a user who wants to be able to continuously display and enjoy the mementos. Alternatively, the items may be displayed by securing them to a bulletin board with thumbtacks, pins or adhesives or by attaching the items to a metallic surface with a magnet. These methods require ancillary devices, may damage the items and do not allow for easy exchange or rearrangement of the displayed items.

Accordingly, there is a need for a products and methods that enable an easy continuous display of mementos which do not require ancillary items to be effective, do not damage the items to be mounted and permit simple exchange or rearrangement of the items. The present invention meets these objections.

SUMMARY OF THE INVENTION

One aspect of the present invention provides a display board comprising a support board, a display panel, a filler material, a holder assembly having at least one memento holder. The display panel is preferably smaller than the support board and is centered on the support board. The holder assembly has an outer edge and an inner edge that defines a window area opening on the interior of the holder assembly for displaying the display panel. The outer dimensions of the holder assembly are preferably the same as the dimensions of the support board and the inner dimensions of the holder assembly are preferably smaller than the dimensions of the display panel. Accordingly, when the frame is assembled, the outer edge of the display assembly is aligned with the edges of the support board and the inner edge of the holder assembly overlaps the edges of the display panel.

The holder assembly may comprise individual holder assembly members. Each holder assembly member comprises a memento board panel, a padding foam attached to the front of the memory board panel, and a fabric stretched over the front of the padding foam and preferably attached to the back of the memory board panel.

The memento holders are situated between the inner and outer edges of the holder assembly. Each memento holder includes a first ribbon positioned across a front surface of the holder assembly between the inner and outer edges, preferably a second ribbon intersecting the first ribbon, and possibly a button placed at the intersection of the ribbons.

Another aspect of the present invention provides a method for displaying mementos comprising providing a display board as described above, hanging the display board in the observable location, and inserting at least one memento into the holder assembly of the display board. The board may be hung on the wall or over the top edge of a door using a sawtooth hangers or over-the-door metal brackets.

BRIEF DESCRIPTION OF THE DRAWINGS

These and other features, aspects, and advantages of the present invention will become better understood with regard to the following description, appended claims, and accompanying drawings where:

FIG. 6 is an enlarged view of the corner of the embodiment of the present invention shown in FIG. 1 and FIG. 2 with a;

DETAILED DESCRIPTION

Figure 1:
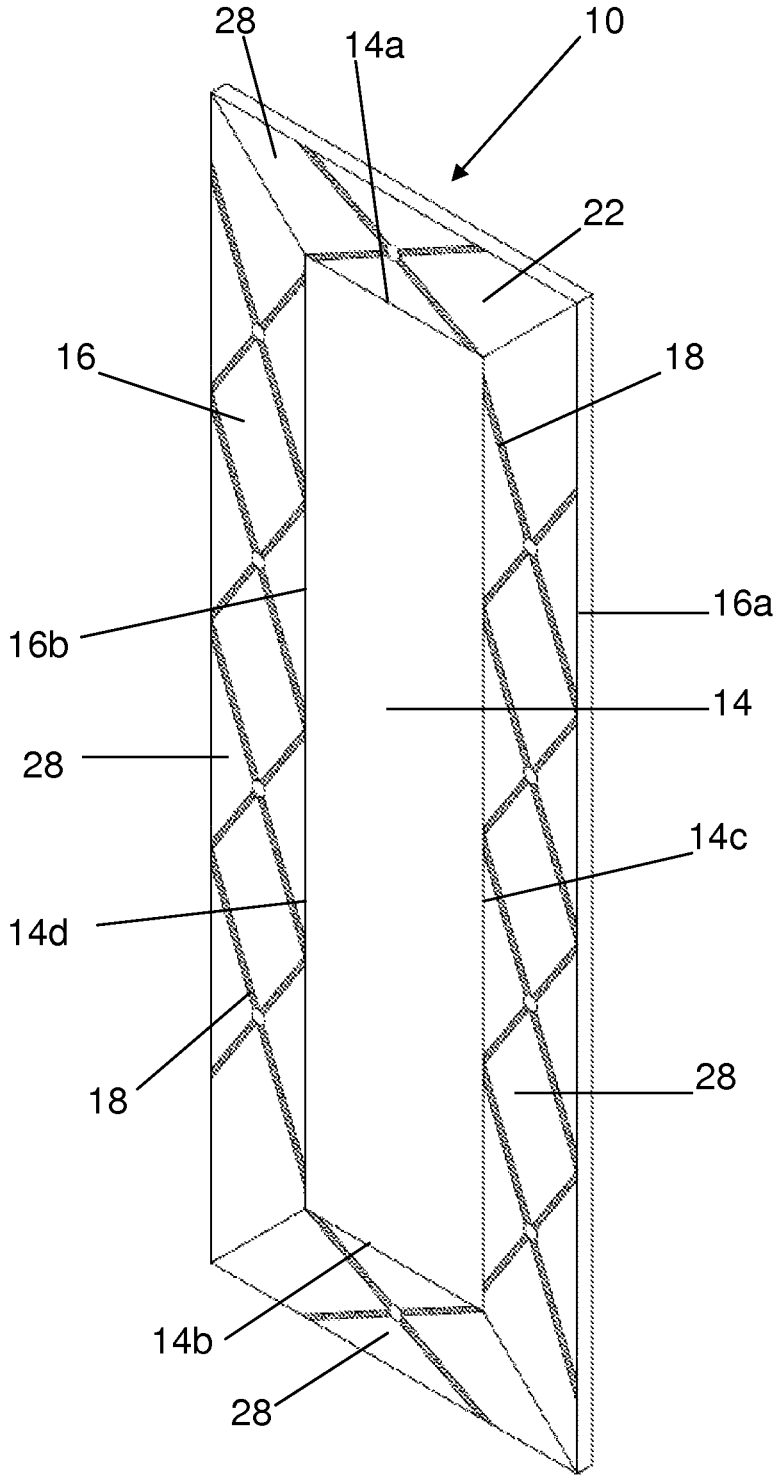
FIG. 1 shows a perspective view of one embodiment of the present invention.

As shown in FIG. 1, a display board 10 comprises a support board 12, a display panel 14, a filler material (not shown), a holder assembly 16, and at least one memento holder 18.

The support board 12 is preferably rigid and sufficiently strong to support a display panel. It can be constructed from cardboard, wood, fiberboards, cork boards, plastic, or foam among others. In the preferred embodiments, the support board is constructed from cardboard to decrease the cost of the final product. The thickness of the support board may vary depending on the type of the material chosen. For example, the support board made from a cardboard is preferably thicker than the support board made from a harder material such as wood.

The support board may be manufactured in any shape. In the preferred embodiments, the support board is rectangular having a top edge 12*a*, a bottom edge 12*b*, a right edge 12*c*, and a left edge 12*d*. The support board can also be cut to any size. In some preferred embodiments, the support board is cut to 50 inches by 18 inches in order for the frame to fit on the back of a typical door.

The display panel 14 may comprise, for example, a mirror, a clear glass, a decorative or colored glass, a picture, a poster, a photograph or other visually appealing image. The display panel 14 is positioned and preferably attached to the front of the support board 12 by any known method. Similar to the support board the display panel can be of any shape. In the preferred embodiments, the display panel is of the same general shape as the support board. Accordingly, it is preferable that the display panel is rectangular with a top edge 14*a*, a bottom edge 14*b*, a right edge 14*c*, and a left edge 14*d*.

The display panel can be of any practical size providing it may be supported by the support board. In one embodiment of the invention shown in FIG. 1 and FIG. 2, the display panel is a display panel that is shorter than the support board by the same length in both the longitudinal and the transverse directions. The display panel can be positioned anywhere on the support board in any orientation. In frame 10, the display panel 14 is centered on the support board 12. That is, the edges of the display panel are parallel to the edges of the support board and the distance between the side edges 12*c* and 12*d* of the support board and the side edges 14*c* and 14*d* of the display panel is the same as the distance between the top and bottom edges of the support board 12*a* and 12*b* and the display panel edges 14*a* and 14*b* respectively.

Figure 10:
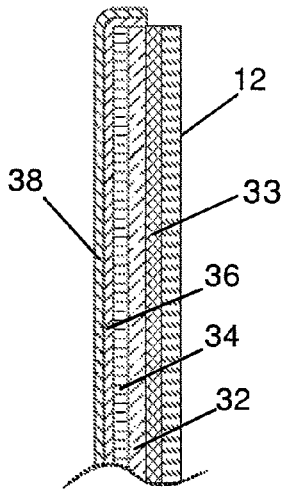
FIG. 10 shows a cross-section view of an alternative embodiment including a filler material between the support board and the holder assembly.

When the display panel 14 is of significant thickness, e.g., when the display panel is a mirror, the gap between the edges of the display panel 14 and the edges of the support board 12 may be filled with the filler material 33 (See FIG. 10). The filler material 33 can be attached to the support board 14 by any known method. The thickness of the filler material 33 is preferably the same as the thickness of the display panel 14. The filler material 33 can be selected from any polystyrene foams, polyurethane foams, cardboard or any other inexpensive materials.

The holder assembly 16 has an outer edge 16*a* and an inner edge 16*b*. The inner edge 16*b* defines a window in the middle of the holder assembly for displaying the display panel 14. In the preferred embodiments, the window defined by the inner edge 16*b* is preferably smaller than the size of the display panel 14. The outer dimensions of the holder assembly 16 are preferably the same as the outer dimensions of the support board 12. Accordingly, when the display board 10 is assembled, the outer edge 16*a* of the holder assembly 16 is aligned with the edges 12*a*-12*d* of the support board 12 and the inner edge 16*b* of the holder assembly 16 overlaps the edges 14*a*-14*d* of the display panel 14.

Figure 8:
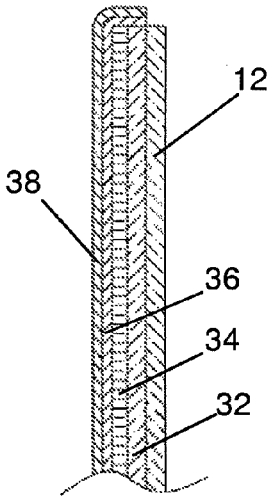
FIG. 8 shows a cross-section view of the holder panel and support board of the present invention.
Figure 9:
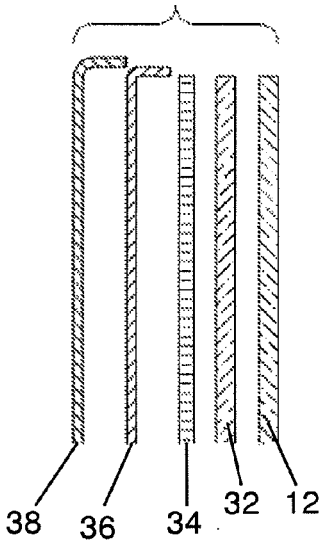
FIG. 9 is an exploded cross-section view of the holder panel and support board of the present invention.

The holder assembly may be manufactured in one piece or separate pieces. For ease of manufacturing, it is preferable that a rectangular shaped holder assembly comprises two longitudinal holder assembly members 22 and two traverse holder assembly members 24. Referring to FIG. 8 and FIG. 9, each holder assembly member 28 comprises a memento board panel 32, a padding foam 34, and a fabric 36. The memento board panel 32 is generally rigid and can be made, for example, of a cardboard. The padding foam 34 is attached to the front of the memento board panel 32. The fabric 36 is stretched over the front of the padding foam 34 and is attached to the back of the cardboard 32. The padding foam and the fabric can be attached to the memory board panel by any known method such as gluing or stapling. The fabric can be of any type or color. It is preferable, however, that the quality and color of the fabric render the frame attractive and pleasant to the eye. In the preferred embodiments, an orange, pink, denim, khaki, and ivory twill fabric is employed. In other embodiments, the fabric may exhibit paraphernalia associated with sports or hobbies. As described above, the holder assembly members 28 are attached to the support board, display panel, and filler material combination.

Figure 2:
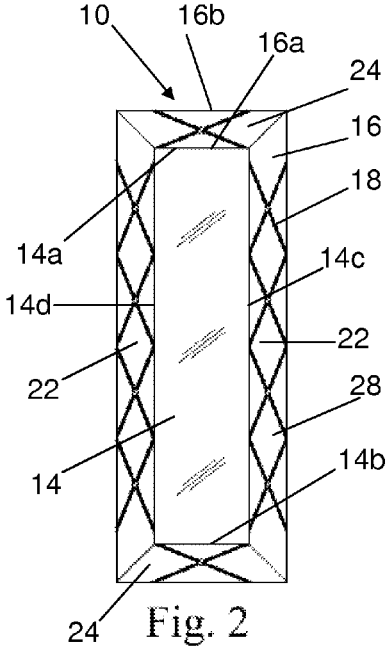
FIG. 2 shows a front view of the embodiment of the present invention shown in FIG. 1.
Figure 4:
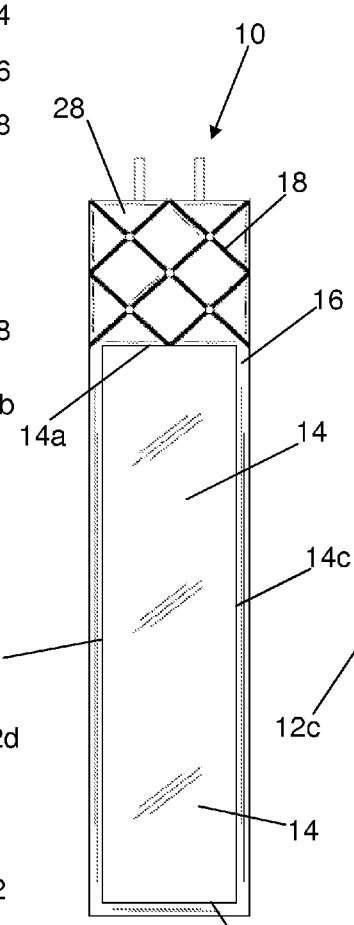
FIG. 4 shows a front view of another embodiment of the present invention.
Figure 6:
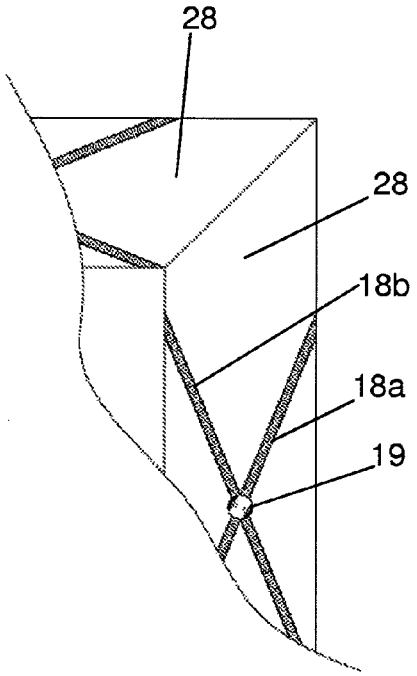

The holder assembly also includes at least one memento holder 18 attached to the holder assembly by any known method. The memento holder is used to display photographs, holiday cards, to-do-lists, concert tickets and any other mementos. As shown in FIGS. 1, 2, and 4, the memento holders can be situated along the holder assembly between the inner and outer edge of the holder assembly. Referring to FIG. 6, one preferred configuration for the memento holder comprises a first ribbon 18*a* and a second ribbon 18*b* intersecting the first ribbon 18*a*. The ribbons maybe selected from any material and color providing that there is a match between the fabric and ribbon color and quality. The memento holder may also include a button 19 attached at the intersection of the first and second ribbons 18*a* and 18*b*. In the preferred embodiments, the button is covered by the same fabric as used for the holder assembly members.

Figure 7:
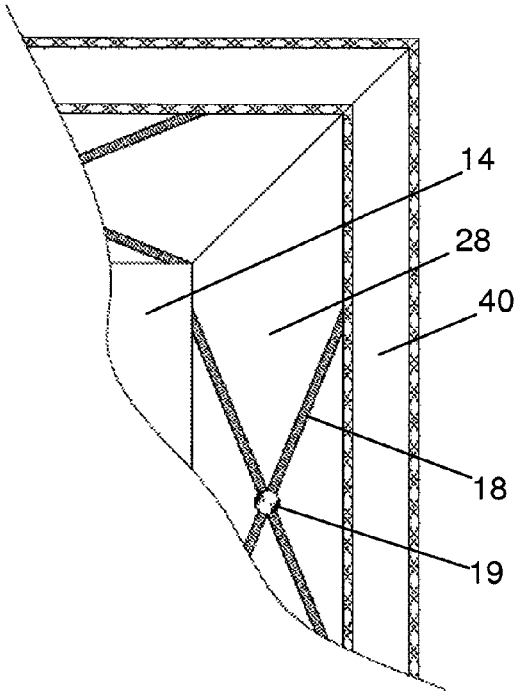
FIG. 7 shows one embodiment of the invention comprising a memory board molding.

As shown in FIG. 7, the frame of the present invention may further include a frame molding 40. The molding may be made of plastic, wood, metal or any other material. The frame molding is attached to the frame by any conventional method.

FIG. 4 shows another embodiment of the present invention. In this embodiment, the memento holders are position on a only on a holder assembly member above the display panel and there are no memento holders on the sides or bottom members of the holder assembly. The distance between the left, right and bottom edges of the display panel and the left, right and bottom edges of the support board in the frame 10 of this embodiment is smaller than in the embodiment shown in FIG. 2. On the other hand, the distance between the top edge of the display panel and the top edge of the support board is significantly larger in the embodiment shown in FIG. 4 than in the embodiment shown in FIG. 2. The display panel 14 is attached in such a way that the distances between the left, right and bottom edges of the display panel 14 and support board are the same resulting in the distance between the top edges to be substantially greater than the distance between other edges. The memento holder 18 is situated only above the display panel because of this placement. All other characteristics of the embodiments of the present invention represented by the frame 10 are the same.

Figure 3:
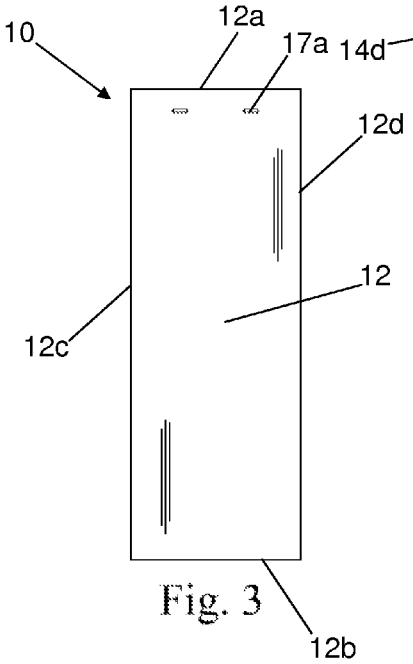
FIG. 3 shows a rear view of the embodiment of the present invention.
Figure 5:
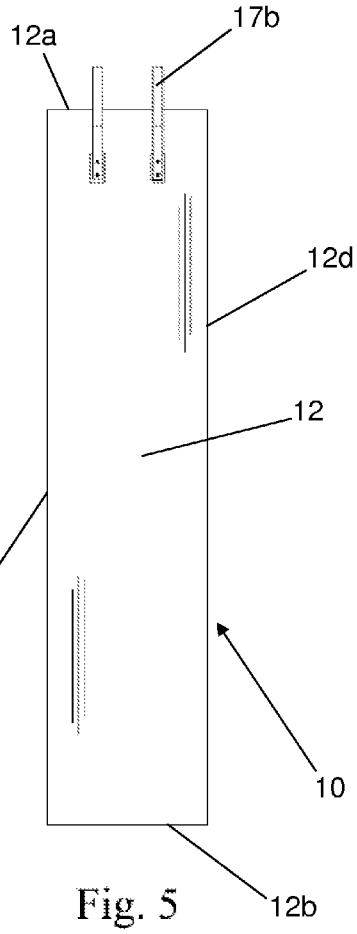
FIG. 5 shows a rear view of the embodiment of the present invention.

The present invention also discloses a method of displaying mementos. In the first step, a frame as described above is provided. In the second step, the frame is placed in an observable location. The frame may be placed on a table or floor or hung on a wall or over a door. For user convenience, the frame may include sawtooth hangers 17*a* as shown in FIG. 3 or over-the-door metal brackets 17*b* as shown in FIG. 5. The sawtooth hanger 17*a* can be used to hang the frame either on a wall or on a door. Although the over-the-wall metal brackets 17*b* can only be used to hang the frame over the door, it is generally easier to hang the frame over the door using the over-the-wall metal brackets 17*b* than the sawtooth hangers 17*b*. In the third step of the method of the present invention, the mementos are displayed by inserting the mementos into the memento holders.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the following claims.

What is claimed is:

1. A display board comprising:

a support board having a front surface and a back surface;

a holder assembly having an outer edge and an inner edge where the inner edge defines a window in the interior of the holder assembly, the holder assembly having a back surface which is planar between the inner and outer edges and which is attached relative to the front surface of the support board; and at least one memento holder disposed on the front surface of the holder assembly and positioned in its entirety between the inner and outer edges of the holder assembly, wherein the at least one memento holder holds a memento by pressing the memento against the front surface of the holder assembly.

2. The display board of claim 1 further comprising a display panel positioned within the window of the holder assembly.

3. The display board of claim 2, wherein the inner edge of the holder assembly overlaps a peripheral edge of the display panel.

4. The display board of claim 2, wherein the support board and the display panel have a longitudinal and a transverse direction and the display panel is shorter than the support board in both the longitudinal direction and the transverse direction.

5. The display board of claim 4, wherein the display panel is centered on the support board.

6. The display board of claim 2, wherein the display panel comprises a mirror.

7. The display board of claim 2 further comprising filler material positioned around the display panel between the holder assembly and the support board.

8. The display board of claim 7, wherein the filler material comprises a polystyrene foam or a polyurethane foam.

9. The display board of claim 2, wherein the display panel has a planar front surface and the planar back surface of the holder assembly is co-planar with or in front of the display panel front surface.

10. The display board of claim 2, wherein the display panel is secured directly to the front surface of the support board independent of the holder assembly.

11. The display board of claim 1, wherein the holder assembly further comprises a holder assembly member comprising: a memento board panel having a front and a back, the back defining the holder assembly planar back surface; a padding foam having a front and a back wherein the back of the padding foam is attached to the front of the memento board panel; and a fabric stretched over the front of the padding foam.

12. The display board of claim 11, wherein the holder assembly comprises two longitudinal holder assembly members and two transverse holder assembly members positioned to form a rectangular frame.

13. The display board of claim 12, wherein the at least one memento holder comprise: a first ribbon positioned across a front surface of the holder assembly between the inner and outer edges; and a second ribbon intersecting the first ribbon.

14. The display board of claim 13, wherein the at least one memento holder further comprises a button positioned at the intersection of the first ribbon and the second ribbon.

15. The display board of claim 11, wherein the at least one memento holder comprise: a first ribbon positioned across a front surface of the holder assembly between the inner and outer edges; and a second ribbon intersecting the first ribbon.

16. The display board of claim 1, wherein the at least one memento holder comprises: a first ribbon positioned across a front surface of the holder assembly between the inner and outer edges; and a second ribbon intersecting the first ribbon.

17. The display board of claim 1 further comprising at least one sawtooth hanger attached to the back of the support board.

18. The display board of claim 1 further comprising at least one over-the-door metal bracket.

19. The display board of claim 1 further comprising a frame molding positioned along a peripheral edge of the holder assembly.

20. A method of assembling a display board, comprising:

securing a display panel to a front surface of a support board; and securing a holder assembly relative to the front surface of the support board, the holder assembly having outer and inner edges where the inner edge defines a window in the interior of the holder assembly, the holder assembly further having a back surface which is planar between the inner and outer edges and a front surface with at least one memento holder disposed thereon and positioned in its entirety between the inner and outer edges of the holder assembly, wherein the at least one memento holder holds a memento by pressing the memento against the front surface of the holder assembly, the holder assembly secured such that the window is aligned with the display panel and the holder assembly back surface is co-planar with or in front of the display panel front surface.

21. The method of claim 20, further comprising the step of securing a filler material about the display panel between the front surface of the support board and the back surface of the holder assembly.

* * * * *